US006431064B1

(12) United States Patent
Claassen

(10) Patent No.: US 6,431,064 B1
(45) Date of Patent: Aug. 13, 2002

(54) SCREEN-PRINTING DEVICE WITH PRINTING-STATION SHIELD

(75) Inventor: Wilhelmus J. A. L. M. Claassen, Boxmeer (NL)

(73) Assignee: Stork Brabant B.V., An Boxmeer (NL)

( * ) Notice: Subject to any disclaimer, the term of this patent is extended or adjusted under 35 U.S.C. 154(b) by 0 days.

(21) Appl. No.: 09/417,665

(22) Filed: Oct. 14, 1999

(30) Foreign Application Priority Data

Oct. 16, 1998 (NL) ..... 1010337
Apr. 1, 1999 (NL) ..... 1011727

(51) Int. Cl.[7] ..... B41L 13/04
(52) U.S. Cl. ..... 101/114; 101/118; 101/126; 101/425
(58) Field of Search ..... 101/114, 115, 101/116, 120, 119, 126, 129, 423, 424, 425, 118; 118/406, 213

(56) References Cited

U.S. PATENT DOCUMENTS 3,987,511 A 10/1976 Mayer et al.
3,992,994 A * 11/1976 Mitter ..... 101/425
4,173,928 A * 11/1979 Mitter ..... 101/126
4,336,753 A * 6/1982 Vidalis ..... 101/127
5,206,970 A * 5/1993 Johnson ..... 101/425

FOREIGN PATENT DOCUMENTS

EP 0 364 918 B1 4/1990
EP 0 391 491 10/1990
EP 0 277 481 B1 7/1991

OTHER PUBLICATIONS

Disclosure of Stork Brabant B.V., *Research Disclosure*, 37350, May, 1995.

* cited by examiner

*Primary Examiner*—Leslie J. Evanisko
(74) *Attorney, Agent, or Firm*—Reising, Ethington, Barnes, Kisselle, Learman & McCulloch, PC

(57) ABSTRACT

Screen-printing device for printing a substrate (6), comprising at least one printing station (2) for a removable screen (10) and a printing-medium feed; and substrate-conveying means (4, 5) for guiding a substrate (6) past the printing station (2) in which device the following are also provided: a movement mechanism for moving the screen (10) and the substrate-conveying means (4, 5) with respect to one another between a printing position and a free position, a shield (15) which can move between an at-rest position and a shielding position, in which shielding position the shield (15) forms a barrier between the screen (10) and the substrate-conveying means (4, 5) or a substrate (6) which is being guided over these means, and liquid-discharge means (20) for discharging liquids which are deposited on a shield (15) which is located in the shielding position.

18 Claims, 13 Drawing Sheets

SCREEN-PRINTING DEVICE WITH PRINTING-STATION SHIELD

BACKGROUND OF THE INVENTION

The invention relates to a screen-printing device.

A device of this nature is generally known. Flat-bed screen-printing devices and rotary screen-printing devices spring to mind. During a screen-printing process, a liquid printing medium, such as ink, paint or paste, is metered through a screen onto a substrate which is to be printed. The substrate is guided past one or more printing stations by means of conveyor means, for example comprising a number of rollers and/or a conveyor belt. Each printing station comprises a screen and a squeegee. Pressure medium is supplied and is printed through the screen by means of a squeegee. The substrate may comprise textile, paper, plastic, metal and the like. If a new design is desired after a printing process, the screens are changed. Since the screens and squeegees used have been in contact with the printing medium, they have to be cleaned. If, following a printing process, the same design, but, a different colour, is desired, the screen is removed from the device and taken to a separate washing chamber, where it is cleaned and then replaced.

A drawback of the known screen-printing devices is that there is a considerable risk that, during changing of a screen, the substrate which is to be printed or has already been printed and is located beneath the screen, or even the device itself, may become dirty or damaged. The risk of the substrate or device becoming dirty is high in particular if screens and squeegees which have just been cleaned are placed in the device, since washing liquid can keep on dripping downwards. Messing of printing medium, washing liquid and the like on a substrate which is to be printed or has been printed, during production, leads to the substrate being rejected or labelled as seconds.

In Research Disclosure No. 37350 (May 1995) a rotary screen printing machine is disclosed, comprising a kind of roller blind which is to be rolled off from a roll and placed between a printing blanket and a set of several screens. The blind is destined for the removal of the set of screens from the machine, washing them in a separate washing machine and putting them back, without the risk of spilling paste onto a substrate.

In addition to the blind being difficult to clean, a major disadvantage of this known machine is that the removal, washing and replacement of the screens takes up considerable manpower and operating time.

Rotary screen-printing devices in which screens are washed on the device itself are also known. By way of example, EP-B-0,364,918 has disclosed a screen wherein a washing-liquid feed chamber is arranged inside the screen. The chamber has a plurality of spray nozzles which are directed at the squeegee and the ends of the screen. Discharge of residues of printing medium and washing liquid take place over the substrate lying below the screen, a piece of cloth which is sewn in between or over the substrate-conveying means.

A drawback of this is that substrate is wasted or has to be resewn, or that the substrate-conveying means have to be cleaned after the liquids have drained off them.

SUMMARY OF THE INVENTION

The object of the invention is to overcome the above-mentioned drawbacks and, in particular to provide a screen-printing device which can be employed flexibly and efficiently.

According to the invention, this object is achieved by means of a screen-printing device according to claim 1. In this device, a screen and substrate-conveying means can be moved with respect to one another between a printing position and a free position, by suitably controlling a movement mechanism. In the printing position, the screen bears against a substrate which is guided past it. In the free position, the screen is located at a short distance from the substrate and/or the substrate-conveying means. A movable shield is provided at the location of the screen. The shield can move between an at-rest position and a shielding position. In the shielding position, the shield is located between the screen and the substrate or the substrate-conveying means and forms a barrier between them. For this purpose, the screen has to be in the free position with respect to the substrate-conveying means. In the at-rest position, the shield is not situated between the substrate and the screen, so that a printing process is possible. The device comprises discharge means for discharging liquid and contaminants which are deposited on a shield which has been placed in the shielding position.

Thus it is advantageously possible, according to the invention, to change and/or wash screens and/or squeegees without the risk of liquids, such as washing liquids or residual printing medium, being deposited on the substrate which is to be printed or has already been printed or on the device itself. In the shielding position, the shield collects all the liquids which run down and discharges them by means of the discharge means. The shield may optionally be placed in the shielding position as soon as a printing station is not used. This ensures that residual printing medium which leaks out-of the screen is collected. In order to prevent the screen from drying out, it may be moistened during prolonged rest periods. Any moistening liquid which in the process is deposited on the shield can be discharged by means of the discharge means. Advantageously, the shield according to the invention may also be used as a guide or insertion support when changing screens on the screen-printing device. The primary function of the shield is to collect and discharge washing liquid if a screen is being cleaned on the device itself. It is thus possible to wash screens and/or squeegees without them first having to be removed from the device and without there being any possibility of contamination to other parts of the device. This increases the efficiency of the device considerably, in particular when a printing process which uses the same design but different colours has to be carried out repeatedly. The work required is then reduced substantially, and considerable time is saved.

The invention provides a screen-printing device which is able to operate very cleanly and reliably. In the case of a plurality of printing stations, it is possible to provide one shield per printing station or per group of printing stations which lie next to one another.

In a preferred embodiment, a washing-liquid feed is provided on the screen-printing device itself. The washing-liquid feed is arranged in such a manner that a screen can be cleaned in the free position. However, it is also possible to clean the screens in the free position with an external washing-liquid feed which does not form an integral part of the screen-printing device.

A further object of the invention is to provide a screen-printing device with a plurality of printing stations which are located one behind the other and with which it is possible to print at one or more printing stations which can be selected as desired, while at the same time, and on the same device, screens and/or squeegees can be changed and/or washed at one or more other desired printing stations without there being any risk of contamination or damage to the substrate which is to be printed or has already been printed or to the screen-printing device itself.

According to the invention, this object is achieved by means of a screen-printing device according to claim 3. A separately operable movement mechanism and a separately operable shield is provided for each separate printing station. It is thus possible to perform highly flexible printing with any desired number of printing stations, while the printing stations which are not in use can be shielded. This prevents printing medium or other liquids being able to pass from these printing stations which are not in use onto the substrate which is to be printed or has already been printed or the device itself. It is advantageously possible, due to the possibility of separate operation, to carry out printing in a continuous process using any desired number of printing stations, while for the printing stations which are not in use the preparations for a subsequent printing process, in which a new design or a different colour is to be printed, can already be ongoing. While a printing process is in full swing, the printing stations which are not being used can be reliably shielded from the printing process, and the screens and/or squeegees can be cleaned, kept moist and the like without them first having to be removed from the device. The liquids which are deposited on the separate shields are discharged by means of discharge means which adjoin these shields.

Further preferred embodiments of the invention are defined in the other claims.

BRIEF DESCRIPTION OF THE DRAWINGS

The invention will be explained in more detail with reference to the appended drawing in which.

DETAILED DESCRIPTION OF THE PREFERRED EMBODIMENTS

Figure 1:
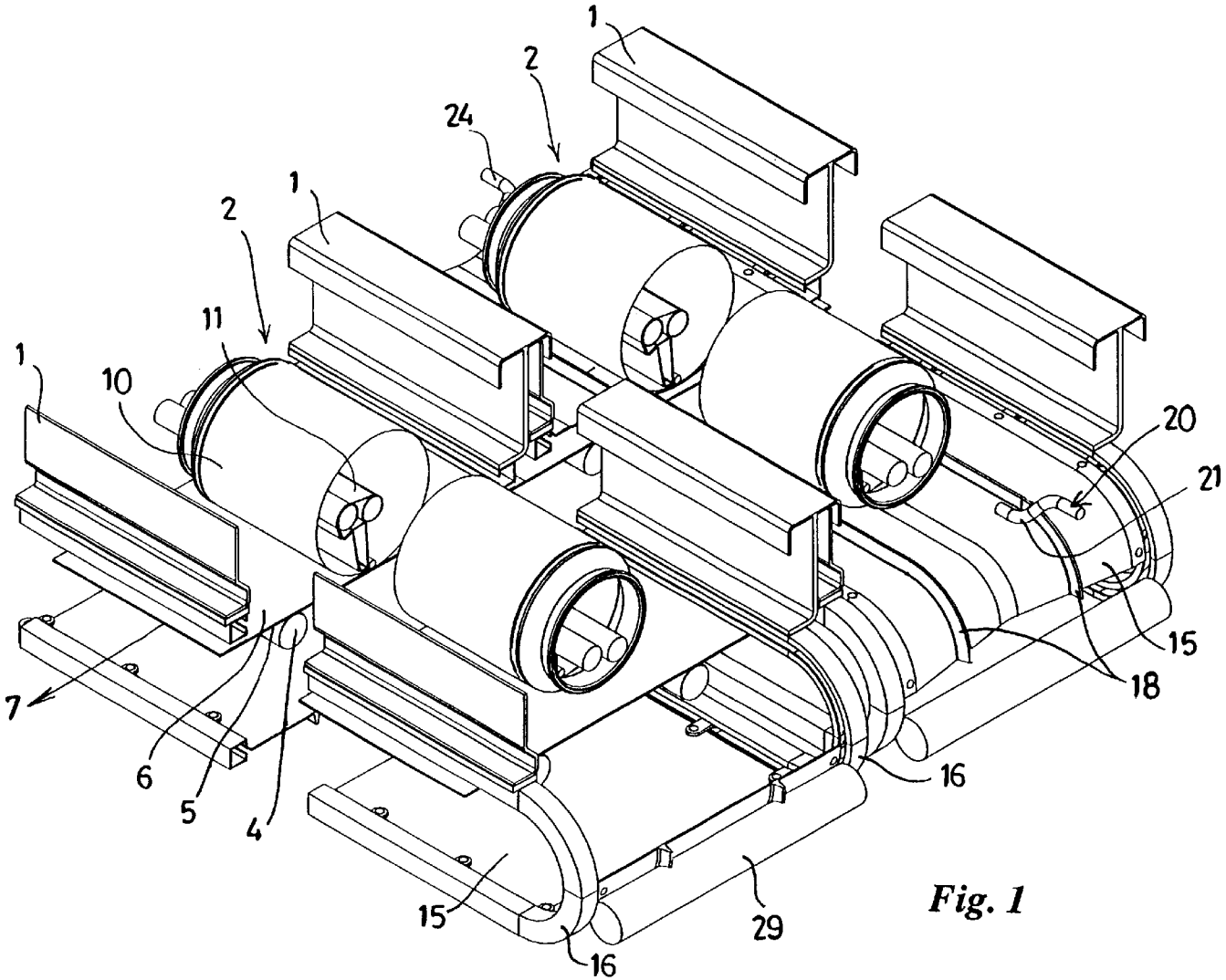
FIG. 1 shows a highly diagrammatic perspective view of two printing stations of a screen-printing device according to the invention, with a shield which is in the at-rest position on the left and a shield which is in a shielding position on the right.
Figure 2:
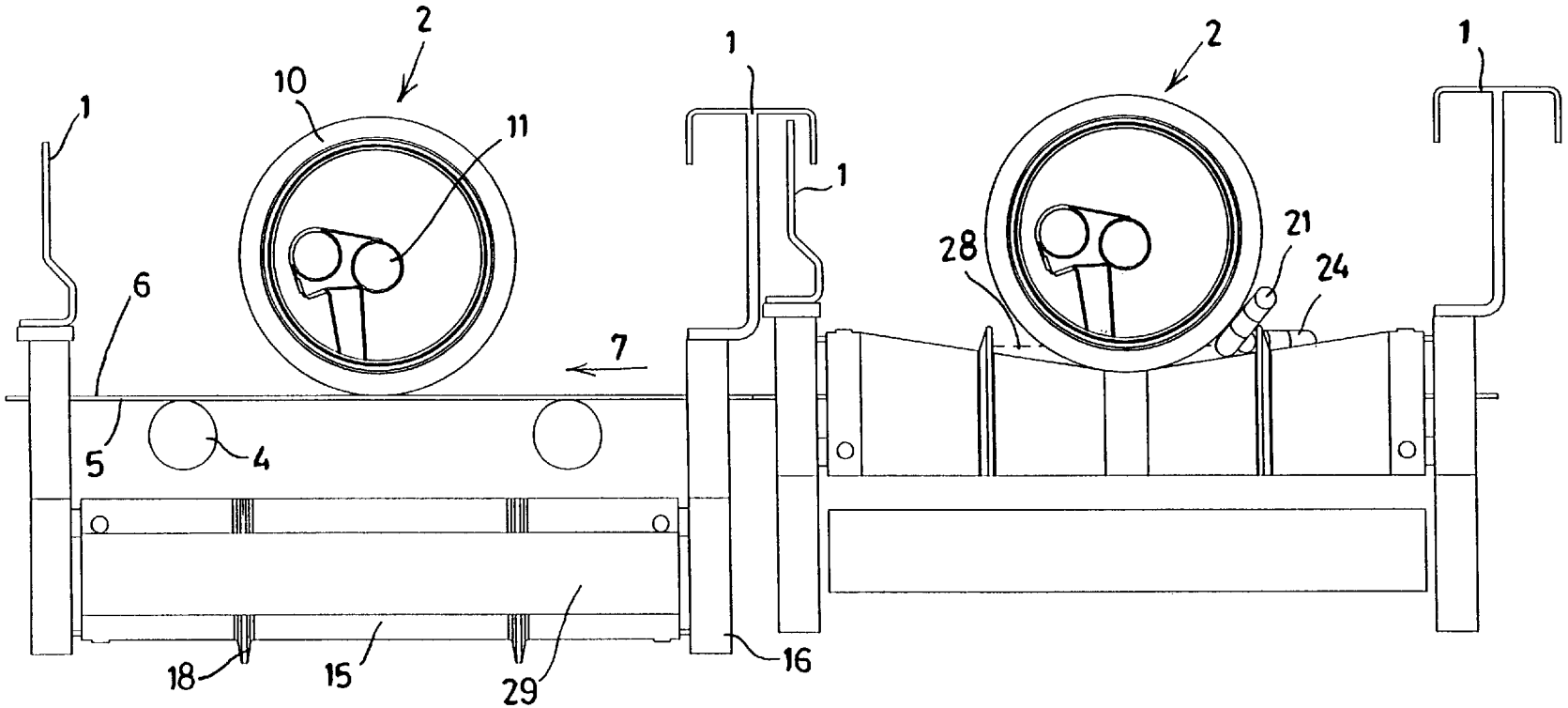
FIG. 2 shows a front view of FIG. 1.

The rotary screen-printing device, only a small part of which is shown in FIGS. 1 and 2, comprises two printing stations 2 which are located next to one another between frame parts 1. A central part of that section of the device which is illustrated has been omitted. As will be clear, the device is in actual fact wider, and the various components extend over the entire width. Beneath the printing station 2, a printing belt 5 with a substrate 6 which is adhesively bonded thereto is guided over rollers 4. The direction of passage of the substrate 6 is indicated by the arrow 7. During a printing process, the substrate is guided past the printing stations 2, where it is printed with a desired image in a desired colour. Each printing station 2 comprises a rotatable screen 10. A squeegee 11 is arranged inside the screen 10. Printing medium of a desired colour can be fed into the inside of the screen 10 via a printing-medium feed, which printing medium, during a printing process, is pressed through the rotating screen 10 by means of the squeegee 11 and is thus deposited on the substrate 6.

The screen 10 can be moved up and down between a printing position and a free position, with the aid of a movement mechanism. In FIGS. 1 and 2, the free position, in which the screen 10 has been lifted a short distance above the substrate 6, is shown for the right-hand printing station. In the space which is left clear between the substrate 6 and the screen 10 which has been lifted into the free position, there is a shield 15. The shield 15 is accommodated in a guideable manner in rail sections 16 which are connected to the frame parts 1. The shield 15 can be moved manually or automatically between an at-rest position and a shielding position. The shielding position is also shown for the right-hand printing station in FIGS. 1 and 2. In the shielding position, the shield 15 forms a liquid-tight barrier between the screen 10 which has been placed in the free position and the substrate 6 or the substrate-conveying means 4, 5.

In the embodiment shown in FIGS. 1 and 2, the shield 15 comprises a flexible, canvas-like body. The canvas-like body hangs down slightly, making the shield into the shape of a gutter. The longitudinal direction of the gutter shape lies parallel to the axis of rotation of the screen 10 and is essentially transverse with respect to the passage direction 7 of the substrate 6. On the top side, the shield 15 is provided with two ribs 18 which project towards the screen 10. The ribs 18 delimit the gutter shape. The shield 15 is arranged in such a manner that it does not bear against the substrate 6. In the embodiment shown, the central part of the shield 15 bears against the underside of the screen 10. It is also possible for a space to be left free between the underside of the screen and the screen. The contact between the screen and the screen may advantageously be engaged and disengaged, for example by means of a tensioning function in the shield or in the suspension of the shield. Consideration may also be given to an inflatable bellows-like body which is arranged on or forms part of the shield.

Liquids and other contaminants which, in the shielding position, are deposited on the shield 15 are then discharged again from the shield with the aid of discharge means 20 lying on the outside of the screen and essentially connecting to the shield. The discharge means 20 are formed, for example, by a suction pipe 21 to which a vacuum is applied. The suction pipe may also extend over the entire length of the screen and may be provided with a plurality of suction openings. This allows suction to be effected more quickly and more efficiently. In an alternative variant, the discharge means may be mounted on or integral with the shield and can thus be moved to and fro between the at-rest position and the shielding position.

As diagrammatically indicated in FIG. 1 and 2, the rotary screen-printing device comprises a washing-liquid feed 24. The feed 24 is connected, for example, to a pipe which extends over the entire length of the screen 10 and which is provided with nozzles which are directed towards the screen surface (cf., for example, FIG. 6). In this way, washing liquid can be sprayed onto the screen 10, thus cleaning the latter. During the cleaning operation, the screen 10 is rotated. Used washing liquid is deposited on the shield 15, which has been placed in the shielding position and from which it is discharged via the suction pipe 21. Due to the gutter shape and the ribs 18 which delimit the gutter shape, it is possible to ensure that a pool of washing liquid remains in place in the gutter shape (this pool is indicated by the dashed line 28 in FIG. 2). This assists with the cleaning process, since the screen 10 can then rotate through a pool of washing liquid.

It is thus advantageously possible to clean a screen 10 while it remains in position in the rotary screen-printing device. It is simply sufficient to place the screen 10 in the free position and to place the shield 15 in the shielding position. In the same way as the discharge means, the washing-liquid feed may also be mounted on or integral with the shield and can be moved to an fro with the shield between the at-rest position and the shielding position. It is also possible to combine the discharge means and the washing-liquid feed, in which case, alternately, washing liquid is supplied and liquid is sucked out via the same pipe.

The shield 15 can be moved in a direction which is substantially transverse with respect to the passage direction 7 of the substrate 6. In the left-hand printing station in FIGS. 1 and 2, it can be seen that the shield 15 has moved to an at-rest position. In the at-rest position, the shield 15 is situated substantially next to and beneath the substrate-conveying means 4, 5. Advantageously, a cleaning roller 29 is provided, and the shield 15 moves past this roller when it is moved from the shielding position into the at-rest position. In an alternative embodiment only a scraper member and cleaning liquid spraying means are provided to automatically clean the shield. It can be seen in the left-hand printing station that the screen 10 is in the printing position, in which it bears against the substrate 6. As can clearly be seen in FIG. 2, it is not only the screen 10 which moves up and down, but also two frame parts 1, to which the shield 15 is attached, during movement from the printing position to the free position and vice versa. In this case, frame parts 1 which lie next to one another are movably connected to one another.

Figure 3:
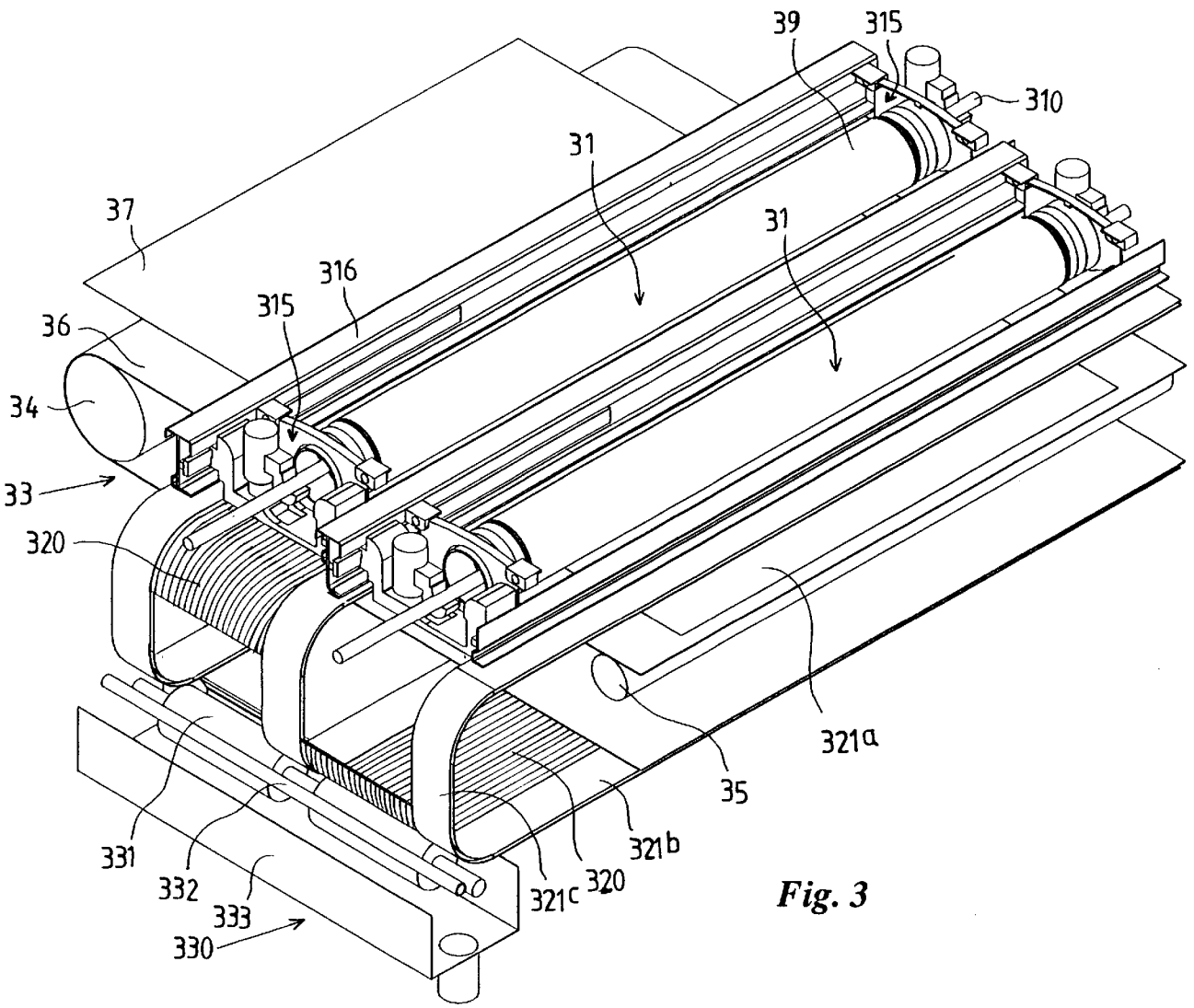
FIG. 3 shows a diagrammatic, perspective view of part of a rotary screen-printing device with two printing stations according to the invention.

Only a left-hand section of a screen-printing device is shown in FIG. 3. In the left-hand section depicted, two adjacent printing stations 31 are shown. Beneath the printing stations 31 there are substrate-conveying means 33. The substrate-conveying means 33 comprise a drive roller 34 and a plurality of guide rollers 35. A printing belt 36 is guided over the rollers 34, 35. During a printing process, a substrate 37 which is to be printed is guided on the printing belt 36 past the printing stations 31, where it is printed with a desired image in a desired colour. Each printing station 31 comprises a rotatable screen 39. A squeegee 310 is arranged inside the screen 39. Printing medium of a desired colour can be fed into the inside of the screen 39 via a printing-medium feed, which printing medium, during a printing process, is pressed through the rotating screen 39 by means of the squeegee 310 and is thus deposited on the substrate 37.

Figure 4:
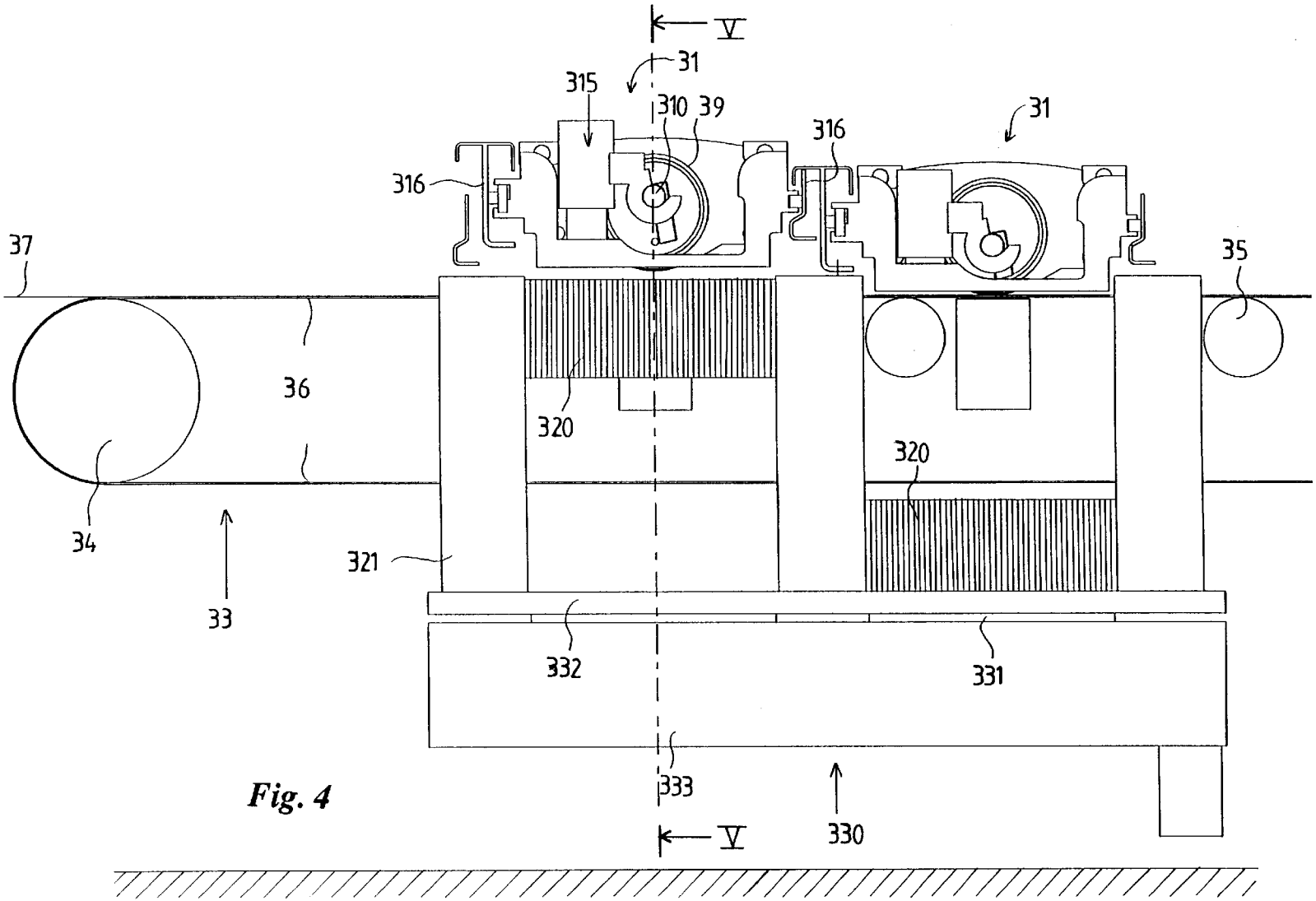
FIG. 4 shows a side view of FIG. 3.
Figure 5:
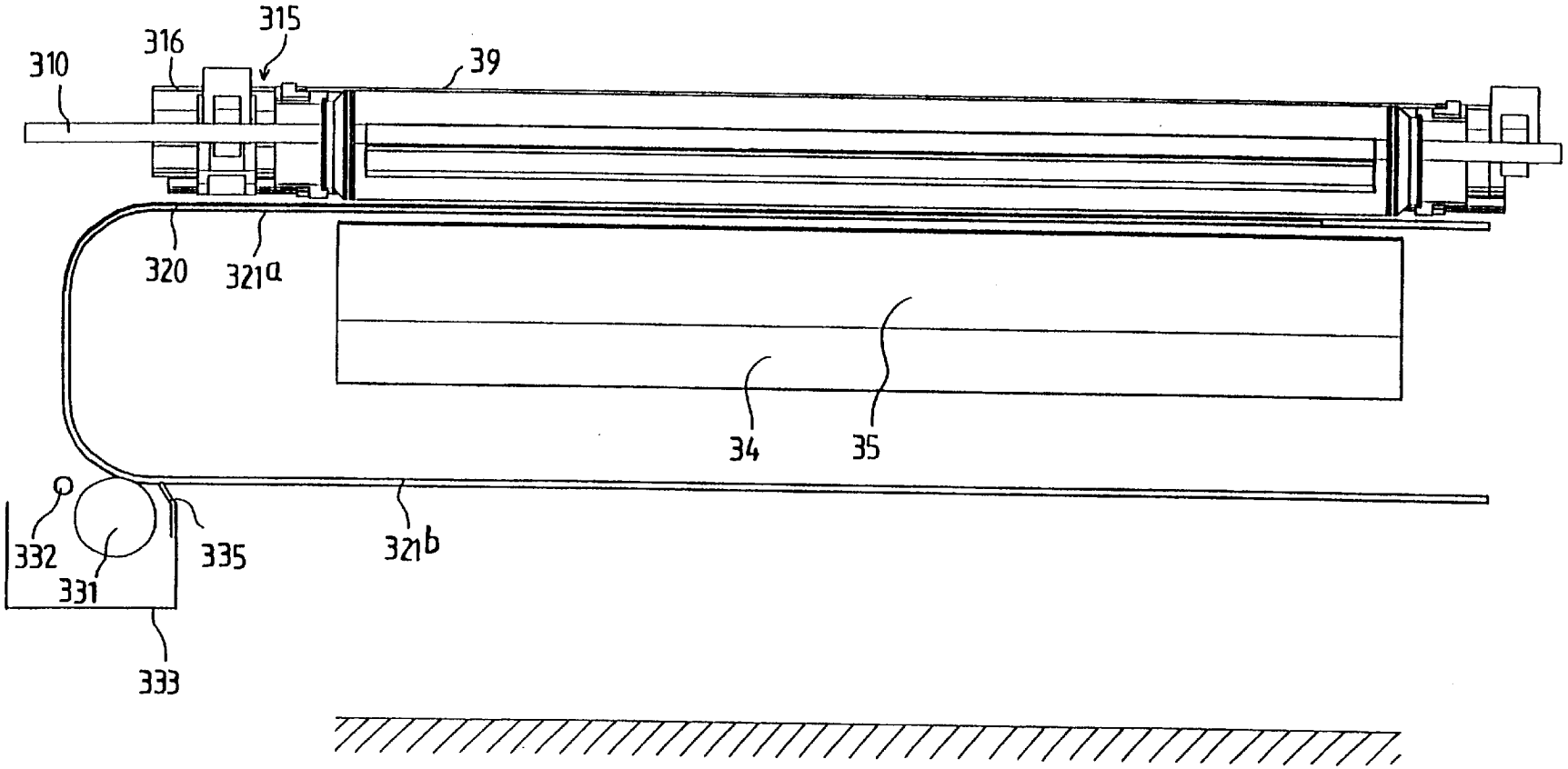
FIG. 5 shows a diagrammatic view on line V—V in FIG. 4.

At the ends, the screen 39 and the squeegee 310 are supported in support means 315. The support means 315 are connected on either side to suspension rails 316 (cf. FIG. 5). The suspension rails 316 are connected to a movement mechanism (not shown), by means of which the suspension rails 316, and therefore the support means 315, the screen 39 and the squeegee 310, can be moved up and down between a printing position and a free position. In FIGS. 3 and 4, the free position, in which the screen 39 has been lifted a short distance above the substrate 37, is shown for the left-hand printing station 31. The printing position, in which the screen 39 bears against the substrate 37, is shown for the right-hand printing station.

Beneath each printing station 31, there is a shield 320 which is guided on both its longitudinal sides in guide rails 321. A first section 321*a* of the guide rails 321 extends between the substrate-conveying means 33 and the printing station 31. A second section 321*b* extends beneath the substrate-conveying means 33. The shield 320 can be moved manually or automatically between a parked position and a shielding position, the first section 321*a* corresponding to the shielding position and the second section 321*b* corresponding to the parked position. In FIGS. 3 and 4, the shielding position is shown for the left-hand printing station 31 and the parked position is shown for the right-hand printing station 31. In the shielding position, the shield 320 forms a barrier between the screen 39 and the substrate 37 or the substrate-conveying means 33. The fact that the second section 321*b* is located beneath the substrate-conveying means advantageously means that the shield 320 is located substantially within the contours of the screen-printing device both in its parked position and in its shielding position. Consequently, the shield is not in the way of an operator even in its parked position, and the dimensions of the screen-printing device with a controllable printing-station shield remain limited. In this case, discharge means 330 are formed by a discharge gutter 333 which is arranged at the end of the shield 320. Preferably, the shield 320 is arranged at a slight angle, so that liquids which are deposited on the shield 320 automatically flow towards the discharge gutter 333.

In the embodiment shown, the shield 320 comprises a flexible canvas-like body which is preferably liquid-tight. The canvas-like body may be stretched taut between the guide rails 321 but may also hand downwards slightly, thus providing the shield 320 with a gutter shape. In the embodiment shown, a space is left clear between the shield 320 which has been placed in the shielding position and the screen 39 which has been placed in the free position. The flexible canvas-like body of the shield 320 can easily be. moved from one position to the other via a curved section 321c of the guide rails 321. In a variant, the canvas-like body is provided with or supported on transverse reinforcement bars. The canvas may then be moved in the manner of a curtain from the shielding position to the parked position.

The guide rails 321 are arranged in a fixed position with respect to the substrate-conveying means 33. In a variant, the guide rails are connected to the suspension rails and then move up and down with the screen between a printing position and a free position.

In particular, a movement mechanism is provided in order to move the shield 320 between the parked position and the shielding position. This allows substantial automation. Advantageously, the movement mechanism of the shield is connected to control means. In order to prevent damage to the shield 320 and/or the screen 39, the control means are designed to block movement of the shield 320 from the parked position to the shielding position as long as the screen 39 is in the printing position with respect to the substrate-conveying means 33. Furthermore, the control means may be programmed in such a manner that the separate shields 320 and screens 39 are actuated individually or, if desired, in groups in a specific order and at set times.

The screen-printing device comprises cleaning means for automatically cleaning the shield 320 when it is moved from the shielding position to the parked position and vice versa. The cleaning means comprise a rotatable cleaning roller 331 which is provided with a brush-like or sponge-like body which is arranged along the path which the shield 320 moves along when it is moving from the shielding position to the parked position. Any contaminants which have been deposited on the shield 320 during shielding are then automatically removed by the cleaning roller 331. Preferably, the cleaning roller 331 is drivable, in order to achieve a thorough cleaning. A tubular spraying component 332 with a plurality of spray nozzles is provided at an angle above the cleaning roller 331, in order to deliver a cleaning liquid. The cleaning liquid delivered can be sprayed both directly onto the shield 320 and onto the cleaning roller 331. The discharge gutter 333 is provided beneath the cleaning roller 331 in order to collect both the cleaning liquid and contaminants which have come off the shield 320 and of the cleaning roller 331. In order to remove stubborn dirt which has, for example, caked onto the shield 320, it is also possible to provide a scraper member 335 (cf. FIG. S). It will be clear that numerous variants are possible for the cleaning means.

Figure 6:
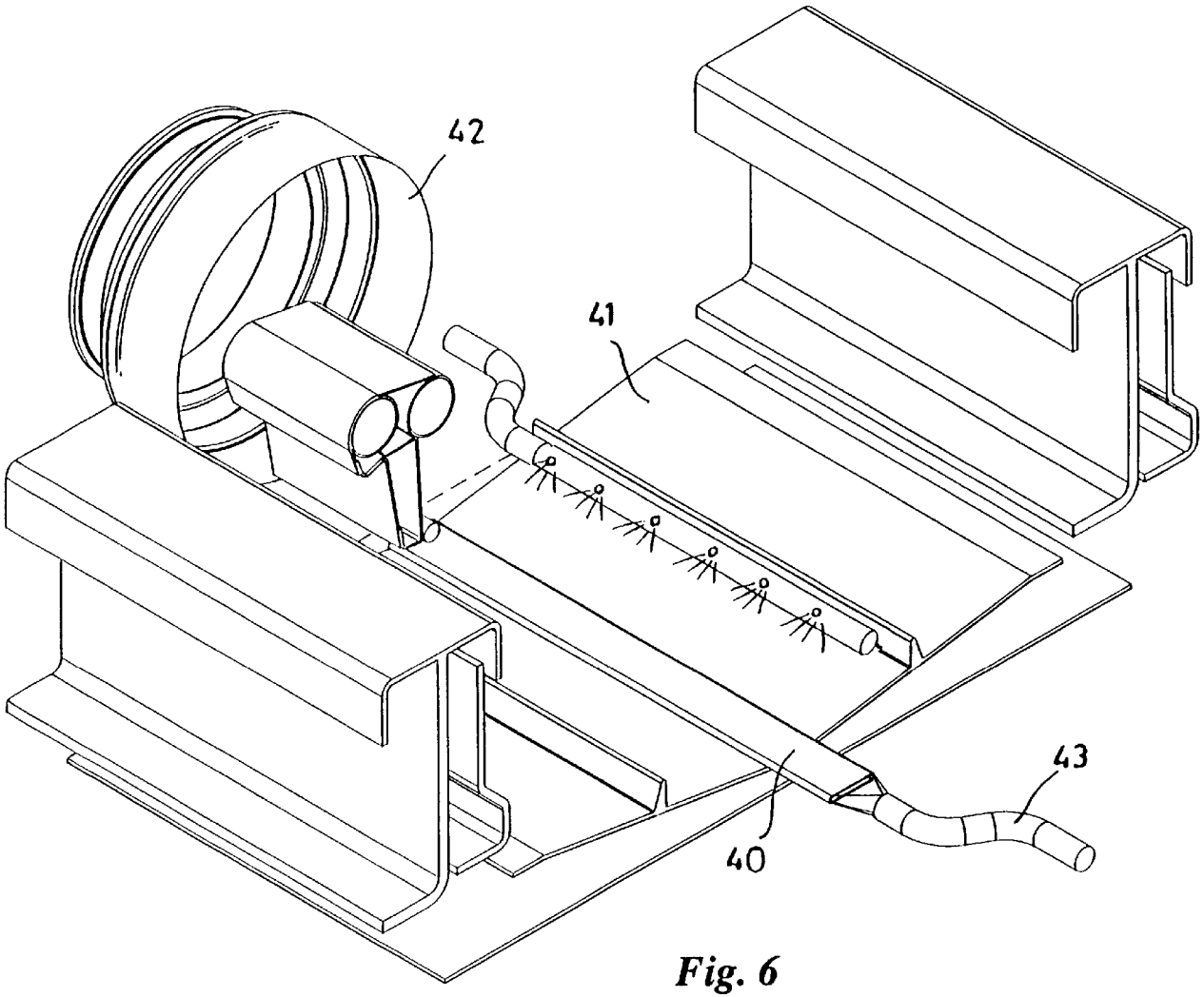
FIG. 6 shows a highly diagrammatic perspective view of a printing station, in which only one end of the screen and squeegee are shown, and in which a contact member is provided.

FIG. 6 shows an embodiment in which a specific contact member 40 is provided on the shield 41. In the shielding position, the contact member 40 is able to bear against the underside of the screen 42. The contact member 40 is formed, for example, by a sponge-like body. The contact member 40 can be used for cleaning a screen 42. Another advantageous contact member 40 which could be used is a scraper-like member for scraping the outer surface of the screen clean, or a brush. It is also possible to use the contact member 40 to moisten the screen 42, in order to prevent it from drying out. To this end, the contact member 40 should have nozzles which are provided with moistening liquid or steam via a feed 43. The contact member 40 advantageously also may form the discharge means for discharging liquids or other contaminants which are deposited on the shield 41, and to this end may be provided with openings and connected to a liquid-suction means. The contact member 40 can also be used for drying the outer surface of the screen 42, for example by blowing hot or cold air through it.

Figure 7:
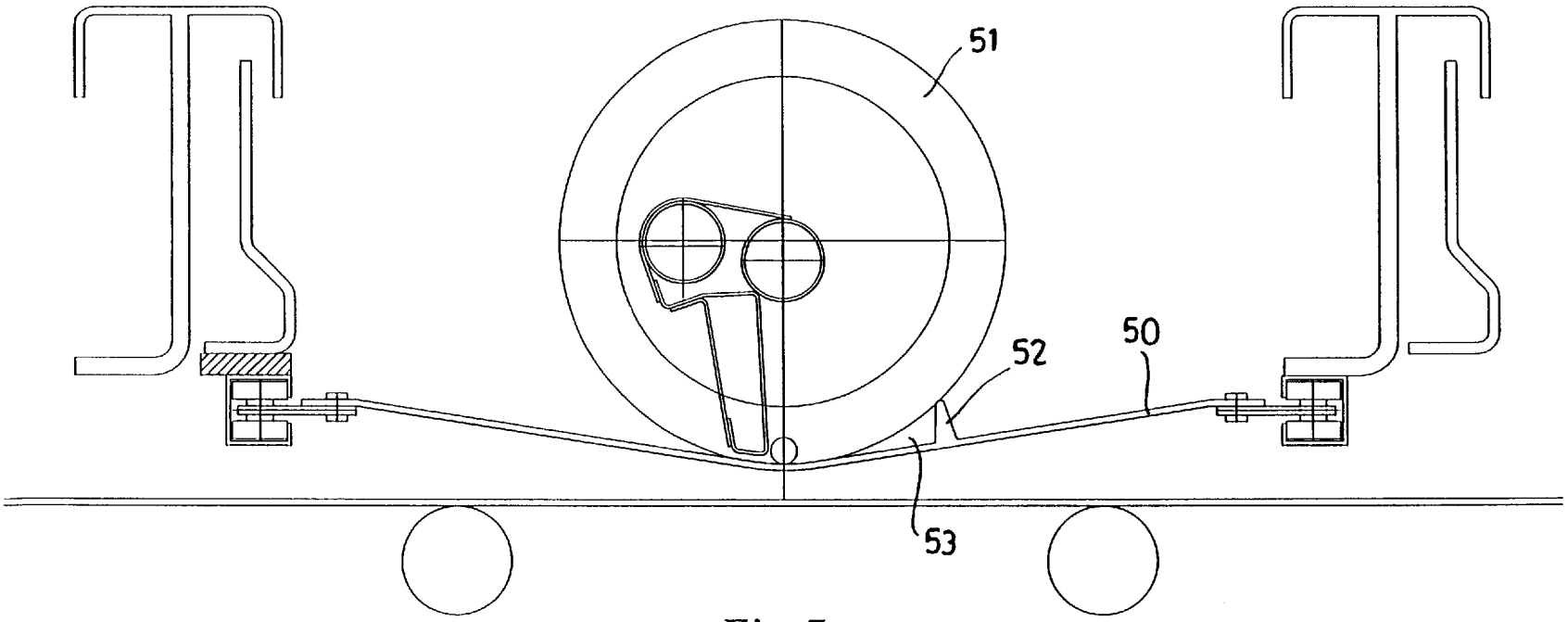
FIG. 7 shows a cross-sectional view through a printing station in which a projecting rib is provided on the shield.

In the embodiment shown in FIG. 7, the shield 5O is again formed by a flexible canvas-like body which bears against the underside of a screen 51. The shield 50 is provided with a projecting rib 52, the free end of which bears against the outer surface of the screen 51. This results in a closed channel 53. The process conditions, such as for example temperature and humidity, within this channel 53 can be monitored and adjusted if appropriate. This is advantageous if the screen is not used for a prolonged period and it is necessary to prevent it from drying out. In addition to moistening liquid, washing liquid can also be fed to the channel 53. This largely prevents splashing during cleaning of the screen 51. The discharge means are preferably formed by a suction pipe which adjoins the closed channel 53 and is connected to a vacuum installation. This contributes to thorough cleaning of the screen 51.

Figure 8:
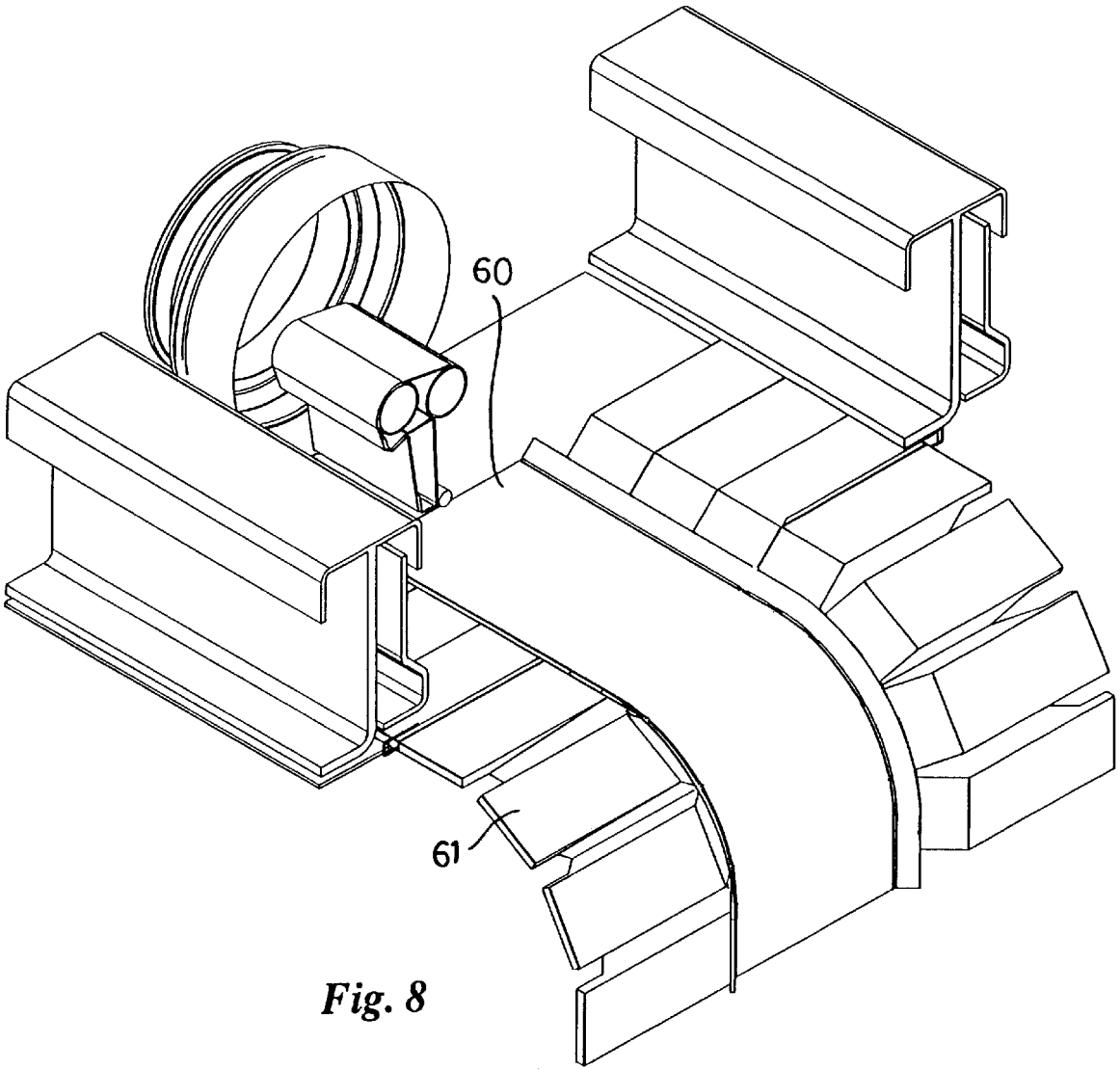
FIG. 8 shows a view corresponding to FIG. 3, in which a shield in the form of lamellae is provided.

FIG. 8 shows an embodiment of a shield 60 which is composed of a plurality of lamellae 61 which are pivotably connected to one another. For the sake of clarity, only one end of the screen and squeegee are shown. The middle part of the top side of the lamellae 61 is provided with a watertight top layer. The separate lamellae 61 of the shield 60 may be of rigid design, with the result that the gutter shape in the shielding position is maintained more successfully and for a longer period, while it is possible to guide the shield 60 through a curve when it is moved from one position to the other.

Figure 9A:
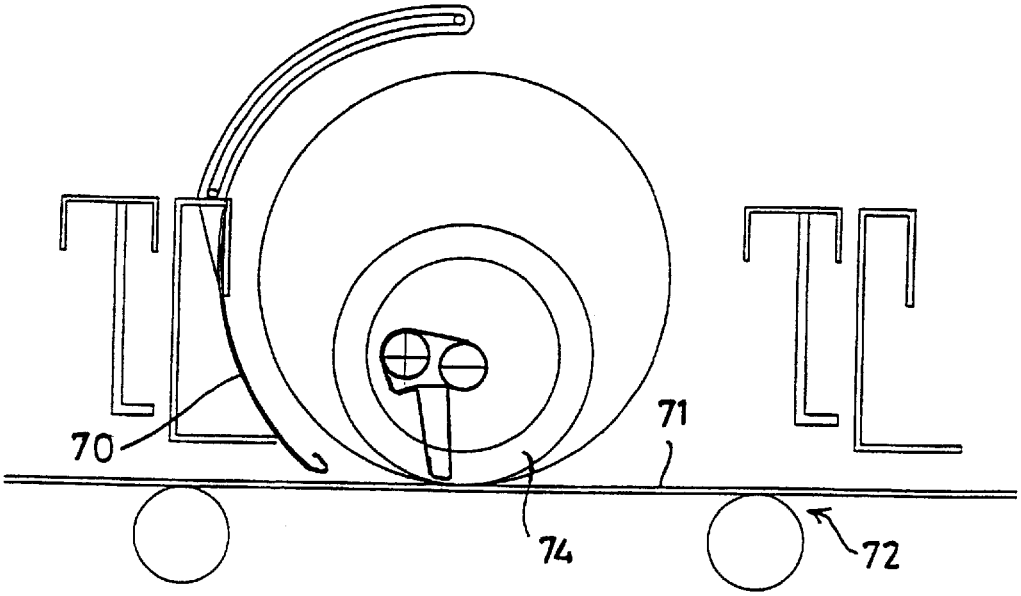
FIGS. 9*a* and 9*b* show diagrammatic, cross-sectional views of a printing station with a shield in the form of a half-sleeve, respectively in an at-rest position and a shielding position.
Figure 9B:
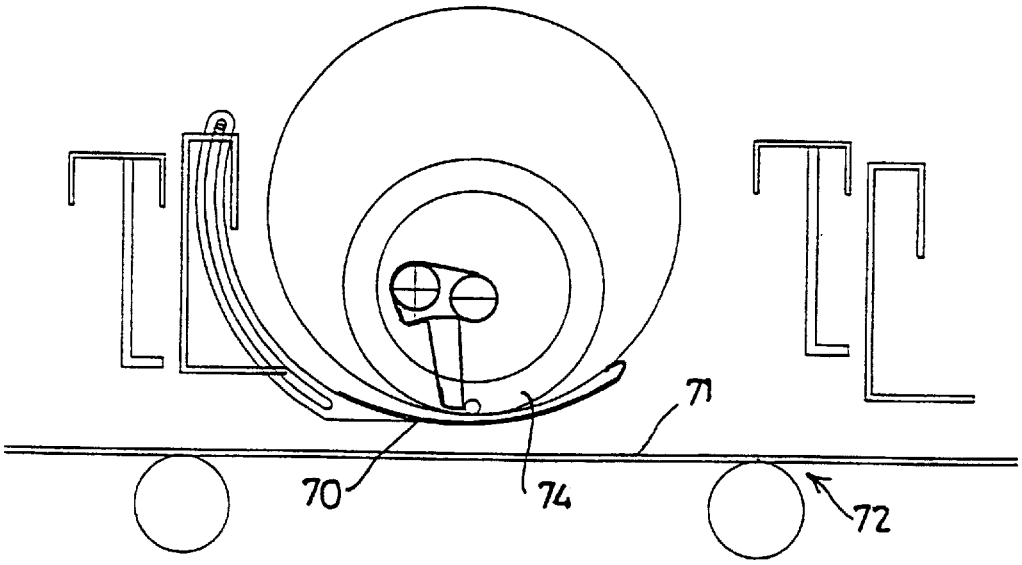

In the embodiment shown in FIGS. 9*a* and 9*b*, the shield 70 comprises a plate which is in the form of a half-sleeve and can be rotated between an at-rest position (FIG. 9*a*) and a shielding position (FIG. 9*b*). In the at-rest position, the shield 70 is located above the substrate 71 and the substrate-conveying means 72. The plate, which is in the form of a half-sleeve, again provides the shield 70 with a gutter shape, by means of which liquids which are deposited on the shield 70 can be discharged with ease without the substrate 71 or the rotary screen-printing device being contaminated in the process. It can also be seen clearly that the screen 74 is in the printing position in FIG. 9*a* and in the free position in FIG. 9*b*. An advantage of this embodiment is that the shield can be of entirely rigid design while, in the at-rest position, it is located substantially next to and above the screen 74 and thus does not take up much space.

Figure 10:
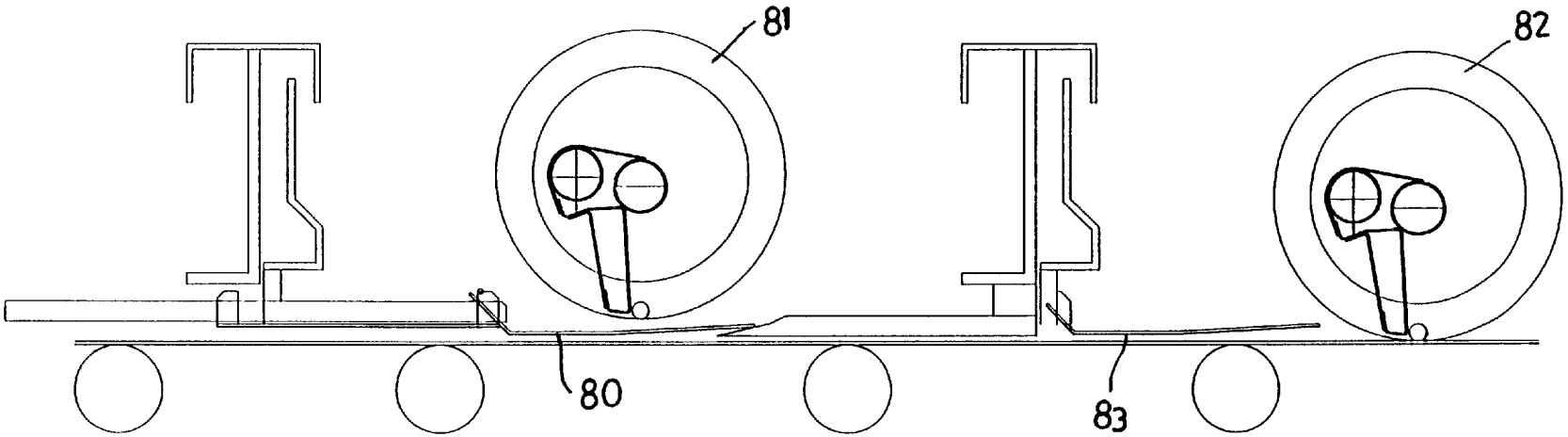
FIG. 10 shows a diagrammatic, cross-sectional view of two printing stations, with a plate-like shield which can be slid away, in a shielding position (on the left) and in an at-rest position (on the right)

FIG. 10 shows an embodiment in which the shield 80 comprises a plate-like body. The plate-like body can be slid away in a plane which is substantially parallel to the direction of passage of the substrate. FIG. 10 shows two printing stations which are located next to one another, the left-hand screen 81 being located in the free position and the right-hand screen 82 being located in the printing position. The left-hand shield 80 is in the shielding position, while the right-hand shield 83 is in the at-rest position.

Figure 11:
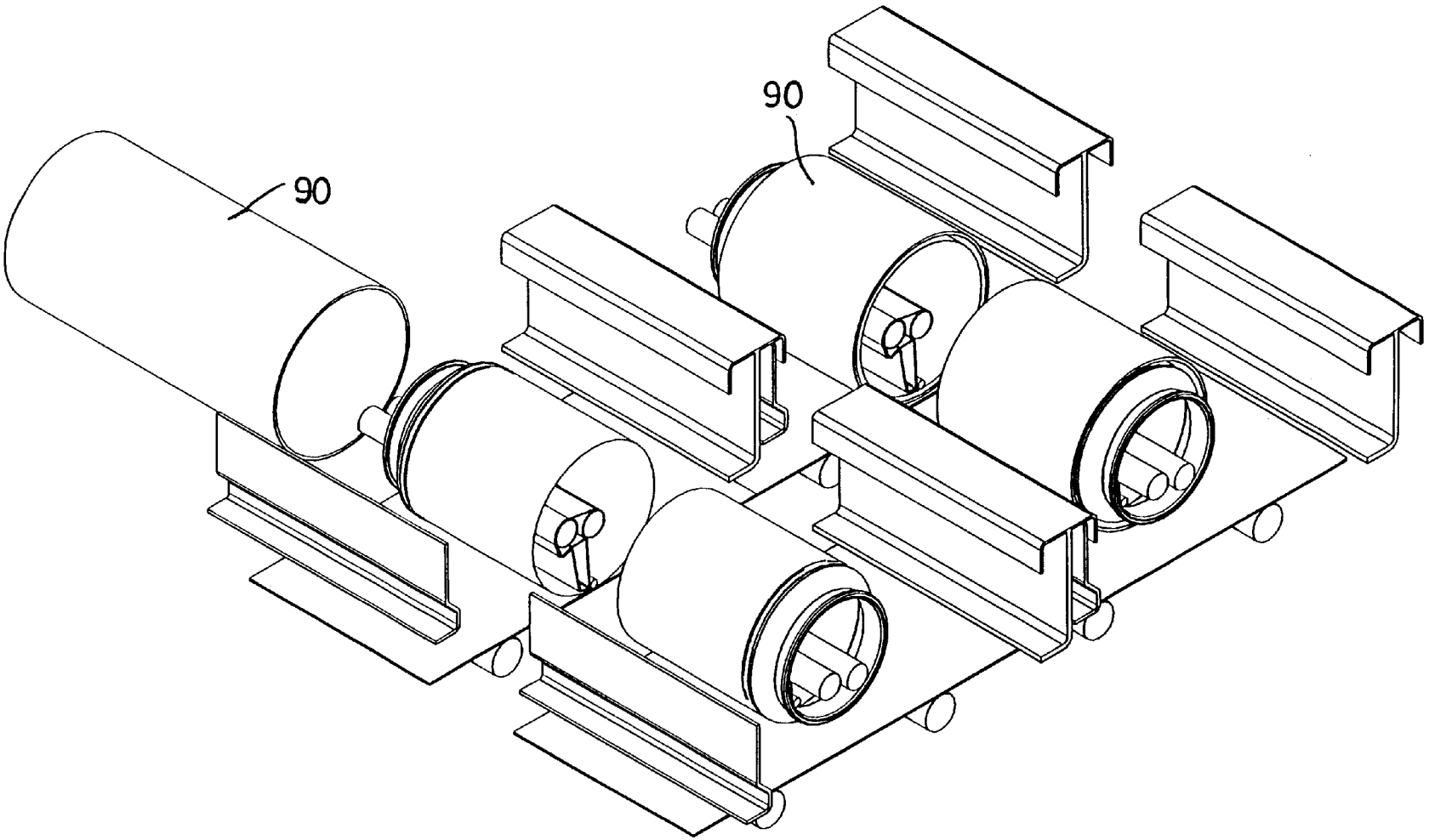
FIG. 11 shows a view corresponding to FIG. 1 with a shield which is in the form of a sleeve.

FIG. 11 shows an embodiment in which the shield 90 comprises a body which is in the form of a sleeve. The sleeve-like body can be slid away laterally in a direction which is parallel to the axis of rotation of the associated screen. In a variant, the sleeve-like body is designed so that it can be folded open. The advantage of the sleeve shape is that a screen can be cleaned without any splashes. It is also possible to monitor the process conditions of the entire screen in the shielding position and, if desired, to adjust these conditions.

FIG. 11, like FIGS. 1, 3 and 10, shows two printing stations which are located next to one another, in two different positions. Since each separate printing station is provided with a separately operable movement mechanism and a separately operable shield, it is possible to print at one printing station while cleaning operations, screen changes and the like are taking place at the other printing station. In addition to individual actuation of the lifting mechanisms and shields, it is also possible for a plurality of adjacent printing stations to be actuated in groups.

Figure 12:
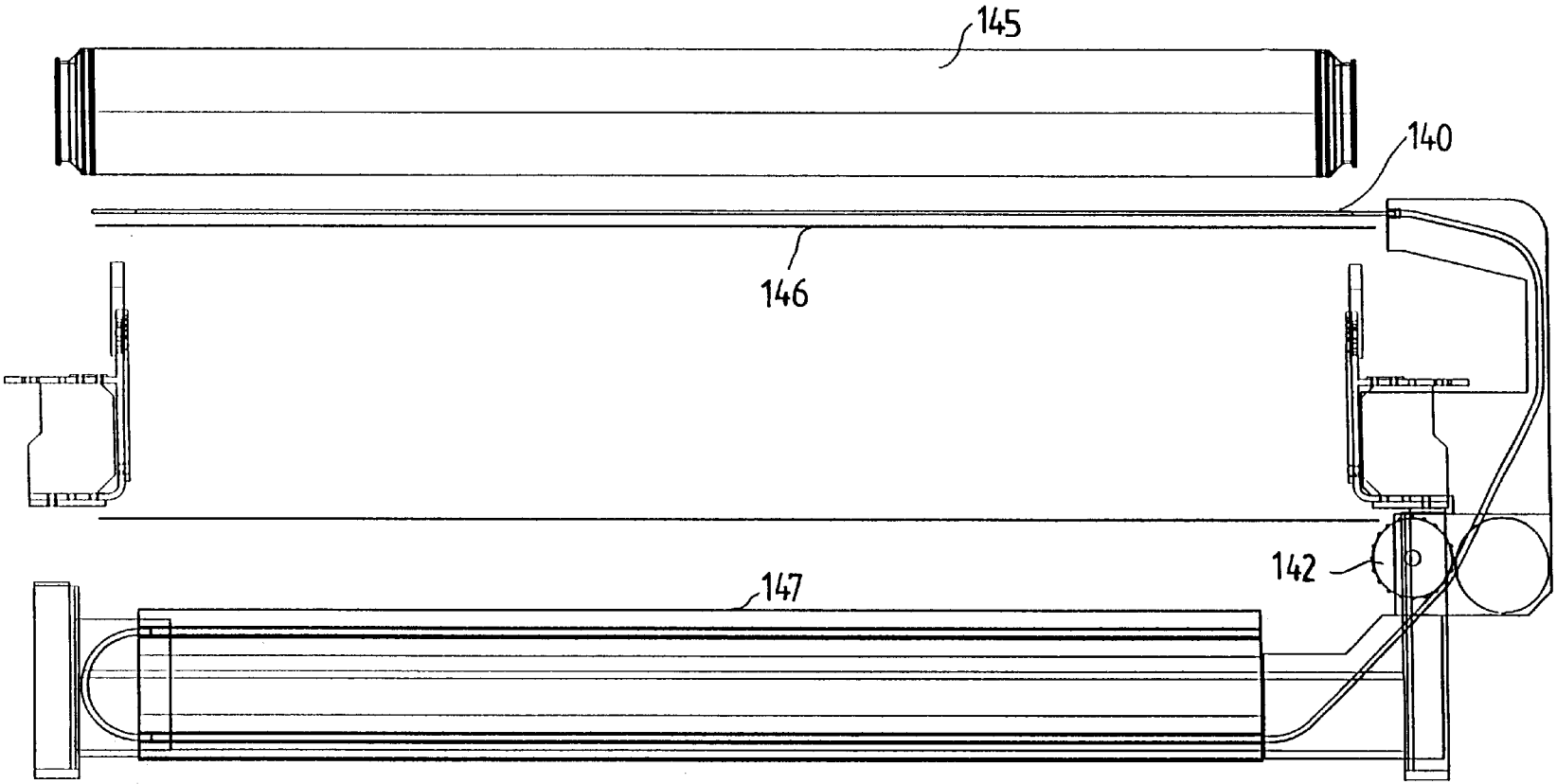
FIG. 12 shows a highly diagrammatic view in accordance with FIG. 5 of a variant embodiment.
Figure 13:
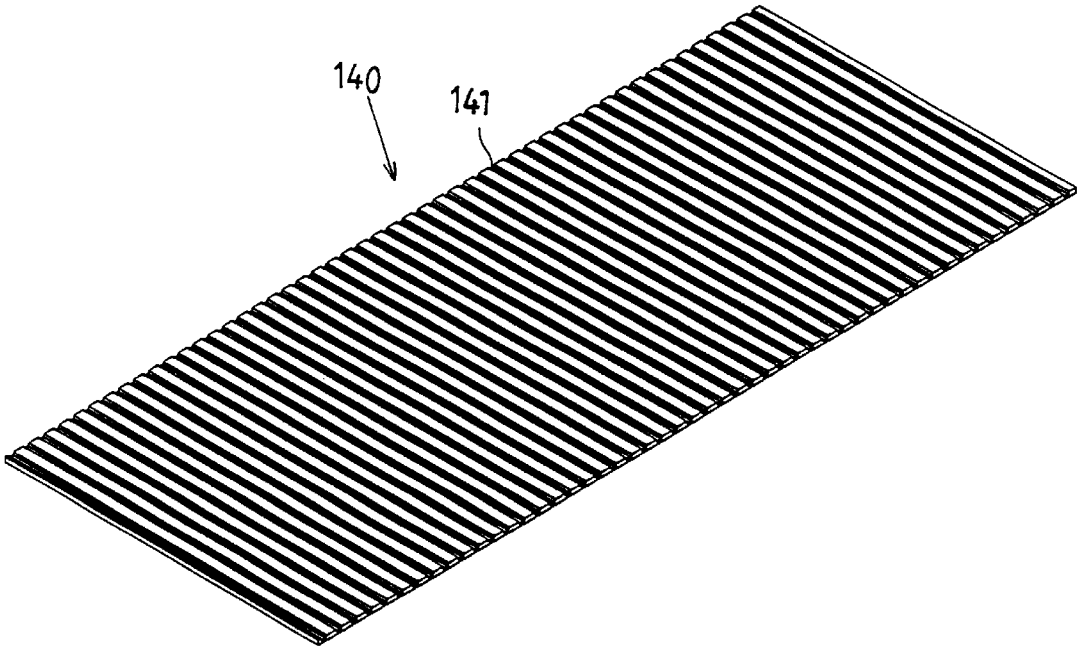
FIG. 13 shows a perspective view of the shield shown in FIG. 12.

FIGS. 12 and 13 show a variant in which the shield 140 is formed by a plastic plate which is provided with profiling on one side. The profiling comprises a plurality of grooves 141 which extend in the transverse direction. The grooves 141 provide the shield 140 with flexural weakness in the direction of movement, while the plate parts which lie between the grooves provide the shield with a certain degree of flexural rigidity in a direction perpendicular thereto. The shield 140 can be moved between a parked position and a shielding position by means of a drive wheel 142. In this case, the drive wheel 142 advantageously engages in the profiling in the shield 140. In the shielding position, the shield 140 is pushed between the screen 145 and the printing belt 146. Beneath the printing belt 146, there is a storage cassette 147, into which the shield 140 is pushed in the parked position. In a variant, the shield is wound onto a reel instead of being stored in the storage cassette 147.

It is possible, according to another aspect of the invention to leave out the aspect of the liquid-discharge means, while using individually shieldable printing-stations. Printing may still be carried out on a screen-printing device using one or more printing stations which can be selected as desired, while at the same time and on the same device screens and/or squeegees can be changed at one or more other printing stations as desired without there being any risk of contamination or damage to the substrate which is to be printed or has already been printed or to the device itself. The shields can be controlled individually for each printing station and are advantageously cleaned automatically on the device itself. Advantageously, the shields prevent the substrate and/or the substrate-conveying means from being contaminated by printing medium or other liquids while the printing stations which are not in use are at a standstill, and in particular while the screens and/or squeegees of these stations are being changed.

The invention relates both to a screen-printing device with only one printing station and to a screen-printing device in which there are a plurality of printing stations located one behind the other. The invention resides in a controllable shield in combination with discharge means for discharging liquids which are deposited onto a shield which is located in the shielding position. The shield has two main functions, namely to form a so-called "wet" barrier during washing and moistening, and a so-called "dry" barrier when the station is not in use, during exchange and drying. Liquids are supplied and discharged when the shield is acting as a wet barrier. When it is acting as a dry barrier, leakage liquid is collected, protection and guidance are ensured during changing of a screen and, if desired, the supply of hot or cold air.

In a variant, the screen-printing device has a plurality of printing stations with controllable shields and one or more printing stations without controllable shields. In this case too, it is possible to carry out printing in a flexible manner in accordance with the inventive idea, since the printing stations which are provided with shields can be deactivated as desired and can be shielded reliably. When exchanging the squeegees and screens, which are often long and heavy, the shields can be used as a guide or support.

Although only a rotary screen-printing device is shown and described, the invention also relates to a flat-bed screen-printing device, in which case a shield can be arranged between each flat screen plate and substrate-conveying means in the raised position.

Only a certain number of embodiments of the shield in combination with the discharge means are shown; a large number of further variants are also conceivable.

What is claimed is:

1. Screen-printing device for printing a substrate, comprising:

at least one printing station having a removable screen;

substrate-conveying means for guiding the substrate past said printing station;

at least one movement mechanism for moving said screen and said substrate-conveying means with respect to one another between a printing position and a free position;

at least one shield which can move between an at-rest position and a shielding position, wherein said shield forming a barrier in said shielding position between said screen and said substrate-conveying means or the substrate which is being guided over these means; and liquid-discharge means for discharging liquids which are deposited on said shield when it is located in said shielding position.

2. Screen-printing device according to claim 1, in which a washing-liquid feed is also provided for the purpose of cleaning said screen in said free position.

3. Screen-printing device according to claim 1, wherein said at least one printing station comprises a plurality of printing stations which are located one behind the other and each have a removable screen and a printing-medium feed; and wherein said at least one movement mechanism comprises a plurality of movement mechanisms and each printing station is provided with a separately operable movement mechanism for moving said screen and said substrate-conveying means with respect to one another between the printing position and the free position; and wherein said at least one shield comprises a plurality of shields and each printing station is provided with a separately operably shield which can move between the at-rest position and the shielding position.

4. Screen-printing device according to claim 1, in which said liquid-discharge means comprise a part which is lying on the outside of said screen and adjoins said shield.

5. Screen-printing device according to claim 1, in which said liquid-discharge means are connected to a vacuum device.

6. Screen-printing device according to claim 1, in which said liquid-discharge means comprise a duct which is provided with a plurality of suction openings and extends in a direction parallel to a longitudinal direction of said screen.

7. Screen-printing device according to claim 1, in which said shield is arranged at an angle in said shielding position.

8. Screen-printing device according to claim 1, in which said liquid-discharge means comprise a discharge gutter.

9. Screen-printing device according to claim 1, in which said shield is in the form of a gutter, at least in said shielding position.

10. Screen-printing device according to claim 1, in which said shield is provided with at least one rib which projects towards said screen and extends in a longitudinal direction of said screen.

11. Screen-printing device according to claim 10, in which part of said shield and said rib, in said shielding position, bear against said screen and delimit a chamber.

12. Screen-printing device according to claim 1, in which said shield is flexurally rigid transversely with respect to a direction of movement of said shield, and flexurally weak in the direction of movement.

13. Screen-printing device according to claim 12, in which said shield (140) comprises a plastic plate with grooves (141) which are provided on the underside and extend transversely with respect to said direction of movement of said shield (140).

14. Screen-printing device according to claim 1, in which a movement mechanism is provided for moving said shield between said at-rest position and said shielding position.

15. Screen-printing device according to claim 13, in which a movement mechanism is provided for moving said shield between said at-rest position and said shielding position, in which said movement mechanism acts on said grooves of said shield.

16. Screen-printing device according to claim 14, in which said movement mechanism of said shield is connected to control means, which control means are designed in a manner that a movement of said shield from said at-rest position to said shielding position is limited as long as said screen is in said printing position which respect to said substrate-conveying means.

17. Screen-printing device according to claim 1, in which said shield is guided on either side between two guide rails, a first part of which extends between said substrate-conveying means and said printing station, which first part is intended for said shielding position of said shield.

18. Screen-printing device according to claim 17, in which a second part of said guide rails extends on that side of said substrate-conveying means which is remote from said printing station, which second part is intended for said at-rest position of the shield.

* * * * *